United States Patent [19]

Palmer

[11] Patent Number: 4,825,781

[45] Date of Patent: May 2, 1989

[54] COLLAPSIBLE TABLE

[75] Inventor: Robert Palmer, Meadville, Pa.

[73] Assignee: Palmer/Snyder Furniture Company, Inc., Conneautville, Pa.

[21] Appl. No.: 155,279

[22] Filed: Feb. 12, 1988

[51] Int. Cl.[4] ..... A47B 3/06

[52] U.S. Cl. ..... 108/153; 108/150; 248/188.1

[58] Field of Search ..... 108/153, 154, 124, 150, 108/159, 158, 118, 129, 132; 248/188.7, 188.1, 151, 158

[56] References Cited

U.S. PATENT DOCUMENTS

| | | | |
|---|---|---|---|
| 914,514 | 3/1909 | Rogers | 108/124 |
| 1,183,645 | 5/1916 | Hubbard . | |
| 2,086,380 | 7/1937 | Flagstad | 108/124 |
| 2,562,022 | 7/1951 | Duer . | |
| 2,791,477 | 5/1957 | Wesbecher . | |
| 2,954,953 | 10/1960 | Mallet-Prevost, Jr. . | |
| 3,103,900 | 9/1963 | Lippman | 108/119 |
| 3,164,347 | 1/1965 | McMasters . | |
| 3,230,909 | 1/1966 | Watson . | |
| 3,230,910 | 1/1966 | Olsson . | |
| 3,244,128 | 5/1966 | Rogalski et al. . | |
| 3,347,509 | 10/1967 | Holz et al. . | |
| 3,589,311 | 6/1971 | Medlen | 108/153 X |
| 3,863,875 | 2/1975 | Olson | 108/153 X |
| 3,871,655 | 3/1975 | Zimmers et al. | 108/150 X |
| 3,934,519 | 1/1976 | Petit | 108/150 |
| 4,092,042 | 5/1978 | Cusenbary | 108/153 X |
| 4,169,625 | 10/1979 | Petersen | 248/188.7 X |
| 4,315,467 | 2/1982 | Vanderminden | 108/157 |
| 4,324,433 | 4/1982 | Saiger | 108/155 X |
| 4,363,460 | 12/1982 | Carroll | 248/188.7 X |
| 4,700,915 | 10/1987 | Killian | 108/150 X |

*Primary Examiner*—Kenneth J. Dorner
*Assistant Examiner*—José V. Chen
*Attorney, Agent, or Firm*—Thomas R. Shaffer

[57] ABSTRACT

A collapsible table is provided which requires no tools for assembly or disassembly. A free-standing base is comprised of two interlocking I-shaped members. One I-shaped member is permanently and pivotably affixed to the under surface of the tabletop, and the other I-shaped member is entirely removable. In operation, the removable leg member is interconnected with the fixed leg member, and locked down under the table by a height-adjustable locking mechanism. The table is broken down by disengaging the removable leg member from the locking mechanisms, folding down the pivotable leg, placing the removable leg on top of the fixed leg, and locking both down by the same locking means.

12 Claims, 2 Drawing Sheets

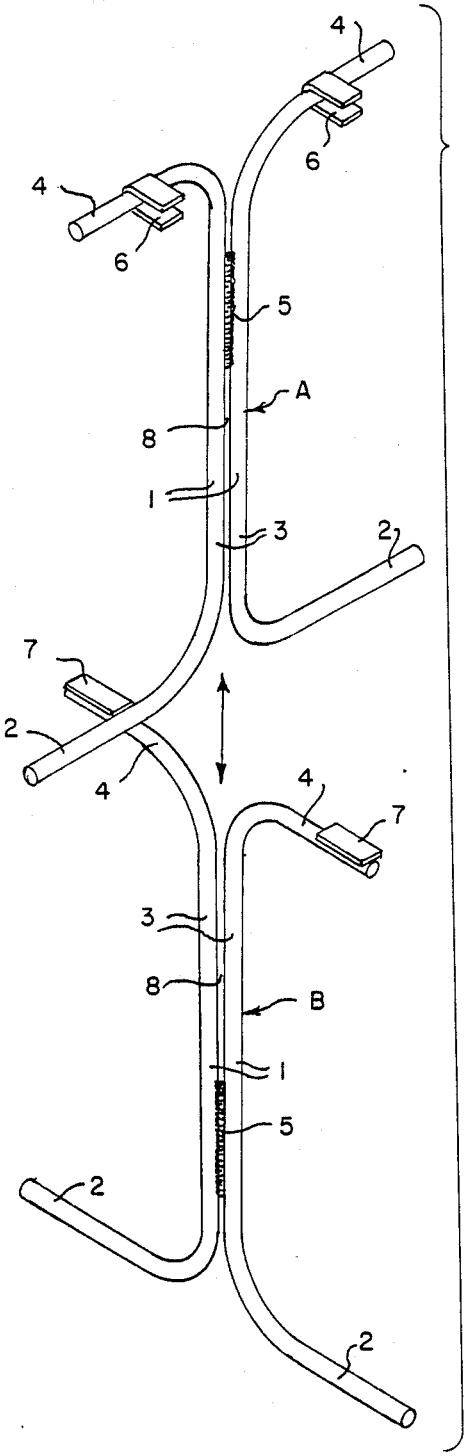
Fig. 1.
Fig. 2.
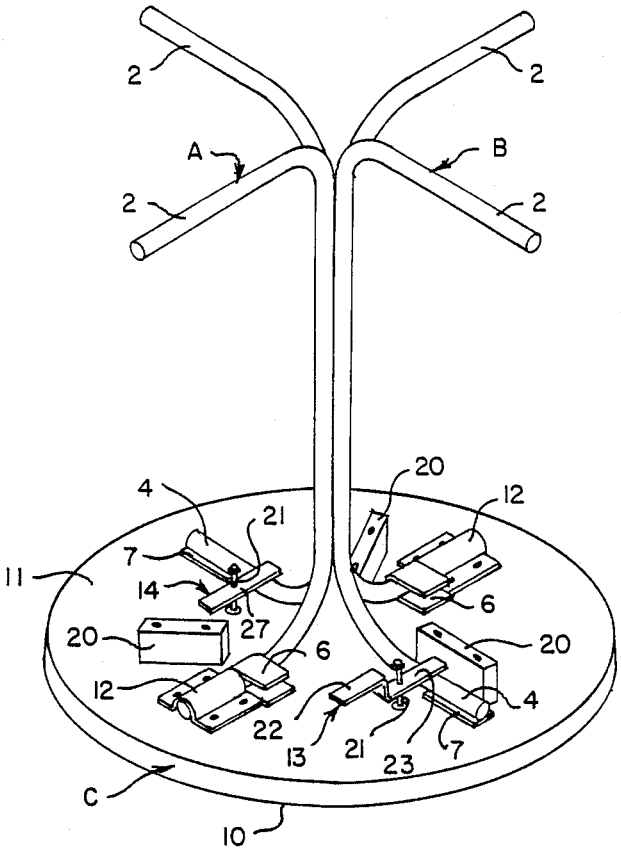

Fig.4.
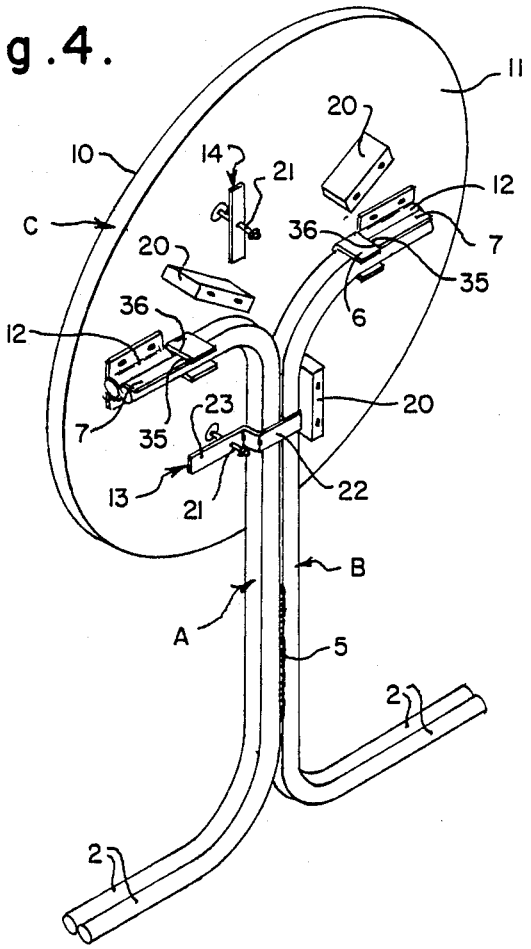
Fig.3b.
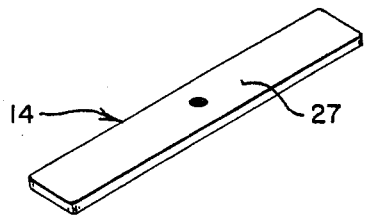
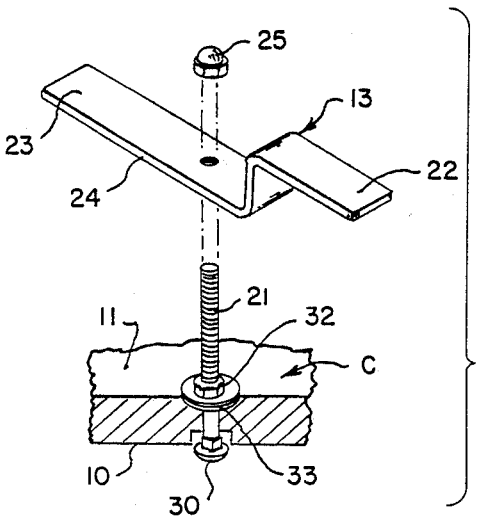
Fig.3a.

COLLAPSIBLE TABLE

BACKGROUND OF THE INVENTION

1. Field of the Invention

The present invention relates to a collapsible table. More specifically, it relates to a collapsible table having a pivotally attached leg member and a removable leg member.

2. Description of the Prior Art

Collapsible tables, chairs and other furniture are well known in the art. In this field many attempts have been made to provide maximum utilization of space in a collapsed position and stability in an assembled position, while still maintaining ease of assembly and disassembly. A number of structures have been proposed to achieve this goal. Of particular interest are those which incorporate interlocking members to form a pedestal base.

Several prior patents describe multiple tubular members utilized to form a pedestal base for a chair. For example, U.S. Pat. Nos. 4,324,433; 4,169,625; and 3,164,347 each teach the use of two I-shaped leg members Which are perpendicularly interconnected to form such a base.

A number of tables having pedestal bases have also been proposed U.S. Pat. Nos. 2,562,022; 3,347,509; 1,183,645; 3,230,909; 3,230,910; and 2,791,477 are examples of some of the pedestal bases for tables which have been proposed. However, most of these bases are either adapted for permanent attachment to a table top by screws or do not collapse into a thin storage position. Other known tables are overly complex and require the use of tools in assembly and disassembly.

There remains, therefore, a need for a table which provides a stable pedestal base, which is easily collapsible into a thin storage position. The table should be assembled and disassembled without the need for tools and which be simple to use and inexpensive to manufacture.

SUMMARY OF THE INVENTION

The collapsible table of the present invention includes a base comprising a pair of elongated leg members. In one embodiment, each leg member is formed from a pair of U-shaped sub-members having center portions thereof connected together in a spaced-apart relationship by a short bar or other connecting means to form a single I-shaped member. The I-shaped members are adapted for relative endwise longitudinal insertion with one another. This forms a solid free standing base.

The base is connected to a tabletop having an upper (working) surface and a lower surface to which the base is attached. One I-shaped leg member is permanently fixed to the table top by a pivot means, such as a bracket, which allows the leg to be rotated between a first position extending perpendicularly from the table top in an assembled position, and a second position parallel and adjacent to the under side of the table top in a collapsed position.

The second I-shaped leg member is completely removable from the table. It engages the first leg member in the assembled orientation of the table as described above, and is disengaged from the first leg member in the collapsed position. In the assembled position, the removable I-shaped leg member is held onto the lower surface of the table top with a suitable locking means affixed to the lower surface of the tabletop adapted for removably securing the removable leg member. Preferably, the locking means secures both the otherwise independent removable leg member and the pivotal leg member to the tabletop when the table is in a collapsed position.

The locking means, in the preferred embodiment of the invention, has two elements. One is a rotatable bar attached by a shaft to the lower surface of the table top. The other element of the locking means is a fixed bar perpendicularly oriented and affixed to the lower surface of the table top. One position of the rotatable bar allows the insert of the legs between the two elements and the bar is then rotated into a locking position. The rotatable bar, in one embodiment, has one end adapted to hold both leg members parallel to the underside of the table when in a collapsed position, and another end adapted to lock only the removable member to the tabletop when in an assembled position. A second embodiment of the locking means has a flat rotatable bar adapted to hold only one leg member at both ends. This embodiment is utilized only in the assembled position of the table. Thus, at least one of the locking mechanisms must be of the first type.

The locking means is preferably adapted to be height-adjustable by rotation of the rotatable bar about a threaded shaft attaching the bar to the lower surface o the table top. This allows fine tuning of the distance necessary to lock down one or two members.

The preferred embodiment of the invention has two pivot means and two locking means, each adapted to be attached to one of the four U-shaped sub-members of the base in an assembled position. Generally, each of the pivot and locking means are positioned on the lower surface of the table top so that a line connecting the pivot means intersects a line connecting the locking means. In most applications, the lines connecting the pivot means and connecting means are perpendicular, allowing the legs to be spaced at 90 degrees from each other. Similarly, the pivot means and locking means are preferably attached to the lower surface of the table top along a circle concentric and smaller in diameter than one including the entire upper surface of the table top.

Thus, when the table is in and assembled position, the I-shaped leg members are interconnected and one (the pivotal leg) is attached to the tabletop by the pivot means, and the other (the removable leg) is attached by the locking means.

When the table is in the collapsed position, the pivoting leg member is retained by the locking means, and the removable leg member is retained on top of the pivotal leg member within the same locking means.

These and other advantages and features of the present invention will be more fully understood on reference to the presently preferred embodiments thereof and to the appended drawings.

BRIEF DESCRIPTION OF THE DRAWINGS

FIG. 1 is an isometric drawing of the leg members of the present invention.

FIG. 2 is an isometric drawing of the present invention in the operative orientation.

FIG. 3*a* is an isometric drawing of one locking mechanism of the present invention.

FIG. 3*b* is an isometric drawing of a portion of another locking mechanism the present invention.

FIG. 4 is an isometric drawing of the present invention in the collapsed orientation.

DESCRIPTION OF THE PREFERRED EMBODIMENTS

Referring to FIG. 1, the base of the table is provided having 2 I-shaped leg members A and B, wherein each leg member is further comprised of 2 U-shaped submembers 1. Each U-shaped member has a top section 4, a center section 3, and a bottom section 2. Top sections 4 and bottom sections 2 are coplanar in the assembled position, and are preferably aligned adjacent to each other in the collapsed position. The top sections 4 of pivotal leg member A, have U-shaped stops 6 attached thereto. Stops 6 add stability to the leg member when in the collapsed position, and prevent sliding lateral movement of the leg member within pivot means 12 (see FIG. 2). The top sections 4 of leg member B have stabilizing means 7 affixed thereto. Stabilizing means 7 are preferably flat plates mounted perpendicularly to the top section 4 to improve stability and contact surface area between leg member B and surface 11 of tabletop C (see FIG. 2). Stabilizing means 7 also prevent lateral movement of leg member B relative to leg member A when the table is in a collapsed position. Connecting means 5, preferably a bar welded to each U-shaped member 1, affix the U-shaped members 1 of both leg members A and B to each other, creating a spaces 8 therebetween.

Leg member B is adapted to be slidably engaged to the leg member A within spaces 8 to form a free standing pedestal base. The connecting means 5 are positioned at a location other than the center of the length of the leg members to allow for a coplanar orientation of top sections 4 and bottom sections 2 of leg members A and B when in an assembled position.

Referring to FIG. 2, a tabletop C is provided having an upper surface 10 and a lower surface 11. Leg members A and B are interconnected as hereinabove described and leg member A is pivotably fixed to the surface 11 by pivot means 12 and stabilized against lateral movement by stop means 6 which engage pivot means 12. Leg member B is removably affixed to surface 11 by locking means 13 and 14 and stabilized by stabilizing means 7 which engage the surface 11 of tabletop C in the assembled position.

In operation, the leg member A is rotated to a position perpendicular to the surface 11 of tabletop C. Leg member B is inserted as hereinabove described and locked down. Locking means 13 and 14 are adjusted prior to the insertion of leg member B by rotating rotatable bars 24 and 27 (see FIGS. 3*a* and 3*b*) to the desired height position on the threaded shaft 21. Leg member B is then locked down by rotating rotatable bars 27 and 24 to positions over and engaging upper portions 4 of leg member B.

Referring to FIG. 3*a*, the locking means 13 has a rotatable bar 24 having an upper end 22 and a lower end 23. Bar 24 is rotatably attached to tabletop C on a threaded shaft 21 of a carriage bolt 30. The head portion of carriage bolt 30 is recessed within the upper surface 10 of tabletop C. Bolt 30 is secured to the tabletop by means of a nut 32 and a rubber washer 33. The rubber washer allows for a small degree of rocking which reduces stress on the components of the locking means.

If desired, the locking means may optionally have a fixed block 20 perpendicularly oriented and affixed to surface 11 of tabletop C to aid in preventing lateral movement of leg member B. Additionally, plural spacing blocks 20 may be provided on the lower surface 11 to allow for stacking of the tables and to prevent damage to the working components of the table.

In operation, the rotatable bar 24 has an upper end 22 adapted to lock down both leg members A and B in the collapsed position, and a lower end 23 adapted to lock down one member B (see FIGS. 2 and 4) in the assembled position. The locking mechanism is adapted to be height-adjustable by rotation of the rotatable bar 24 about threaded shaft 21. An acorn nut or other suitable cap 25 is affixed to the end of shaft 21 to prevent the accidental removal of bar 24 while adjusting the height of the bar and to protect users from sharp edges.

Referring to FIG. 3*b*, locking means 14 has a rotatable bar 27 having two identical ends. Rotatable bar 27 is attached to the tabletop C by a carriage bolt 30 in the same manner as bar 24 described above.

Referring to FIG. 4, the present invention is shown in a collapsed position, the pivotal leg member A is retained by upper end 22, locking means 13, and the removable leg member B is retained on top of the pivotal leg member A within the same locking means. In operation, bar 24 is rotated about shaft 21 until the correct height is achieved. Bar 24 is then rotated to a position over and engaging the top leg member B. In the collapsed position, stabilizing means 7 are positioned directly over pivot means 12 and have inside edge portions 35 adapted to engage outside edge portions 36 of stop means 6. With this arrangement, lateral movement of removable leg member B is effectively precluded.

While I have described a present preferred embodiment of the invention, it is to be distinctly understood that the invention is not limited thereto but may be otherwise embodied and practiced within the scope of the following claims.

I claim:

1. A collapsible table comprising:

(a) a tabletop having an upper surface and a lower surface;

(b) a first pivotal leg member having a pair of U-shaped subportions connected together to form a generally I-shaped member, said first leg member having a pair of outwardly extending upper end portions pivotally connected to the lower surface of said table top, a pair of outwardly extending lower end portions and a pair of spaced-apart central portions extending therebetween connected together in a spaced relationship by connecting means;

(c) a second removable leg member having a pair of U-shaped subportions connected together to form a generally I-shaped member, said second leg member having a pair of outwardly extending upper end portions, a pair of outwardly extending lower end portions with a pair of spaced-apart central portions extending therebetween connected together in a spaced relationship by connecting means, said second leg member adapted for lengthwise insertion into said first leg member at a ninety degree angle relative thereto to form a free standing pedestal base having four outwardly extending upper ends, four outwardly extending lower ends and a central column portion extending therebetween formed from said central portions;

(d) at least two spaced-apart locking means affixed to the lower surface of the tabletop for removably securing the second leg member to the lower surface of the table top, said two spaced-apart locking means secures each of the upper ends of the second removable leg member to the lower surface of the table top when said table is in an assembled position and at least one of said locking means secures the central portions of both the first and second leg members adjacent the lower surface of the table top when said table is in a collapsed position.

2. A table as described in claim 1, wherein in a collapsed position, the pivotal leg member is retained by the locking means, and the removable leg member is retained on top of the pivotal leg member by the same locking means.

3. A table as described in claim 1, wherein each locking means is further comprised of a rotatable bar having two ends, rotatably attached to the lower surface of the table top intermediate said ends.

4. A table as described in claim 3, wherein the rotatable bar has one end spaced from the lower surface of the table top at a distance to receive and to lock down both leg members, and an opposite end spaced from the lower surface of the table top at a distance to receive and to lock down one of said leg members.

5. A table as described in claim 4, wherein the distance of the ends of the locking means from the lower surface of the tabletop is adjustable by rotation of the rotatable bar about a threaded shaft attaching the bar to the lower surface of the table top.

6. A table as described in claim 3, wherein the rotatable bar of one locking means has both ends spaced from the lower surface of the table top at a distance to receive and to lock down one of said leg members.

7. A table as described in claim 1, wherein two locking means are provided, each attached to the lower surface of the table top so that a line connecting said upper end portions of the pivotal leg member intersects a line connecting two spaced-apart locking means.

8. A table as described in claim 7, wherein a line connecting said upper end portions of the pivotal leg member and a line connecting the two spaced-apart locking means are perpendicular.

9. A table as described in claim 1, wherein the upper end portions of the pivotal leg member and a pair of locking means are attached to the lower surface of the table top along a circle having a center located at a central location of the table top.

10. A table as described in claim 1, further comprising stop means affixed to at least one of the upper end portions of the pivotal leg member to prevent rotation of said pivotal leg from a collapsed position wherein said leg is parallel and adjacent to the tabletop beyond an assembled position wherein said leg is generally perpendicular to said tabletop, said stop means adapted to engage the lower surface of the tabletop in the assembled position.

11. A table as described in claim 1, further comprising stabilizing means including a generally flat upper surface portion, said stabilizing means affixed to uppermost ends of the removable leg member, with said flat surface portion adapted to engage the lower surface of the tabletop in the assembled position.

12. A table according to claim 11 wherein said stabilizing means is positioned adjacent a stop means provided on said pivotal leg and prevents lateral movement of the removable leg member when in a collapsed position.

* * * * *

UNITED STATES PATENT AND TRADEMARK OFFICE

CERTIFICATE OF CORRECTION

PATENT NO. : 4,825,781

DATED : May 2, 1989

INVENTOR(S) : Robert Palmer

It is certified that error appears in the above-identified patent and that said Letters Patent is hereby corrected as shown below:

Column 1, line 24, change "Which" to --which--.

Column 1, line 27, after "proposed" insert --.--.

Column 2, line 26, change "o" to --of--.

Column 2, line 66, after "mechanism" insert --of--.

Signed and Sealed this

Fifteenth Day of May, 1990

*Attest:*

HARRY F. MANBECK, JR.

*Attesting Officer*

*Commissioner of Patents and Trademarks*